US007578715B2

(12) United States Patent
Wilkie

(10) Patent No.: US 7,578,715 B2
(45) Date of Patent: Aug. 25, 2009

(54) TOWABLE RECREATIONAL WATER BOARD

(75) Inventor: David Wilkie, Western Australia (AU)

(73) Assignee: Polyline Industries Pty. Ltd., Jandakot (AU)

( * ) Notice: Subject to any disclaimer, the term of this patent is extended or adjusted under 35 U.S.C. 154(b) by 258 days.

(21) Appl. No.: 10/598,324

(22) PCT Filed: Feb. 25, 2005

(86) PCT No.: PCT/AU2005/000259

§ 371 (c)(1),
(2), (4) Date: Aug. 24, 2006

(87) PCT Pub. No.: WO2005/082705

PCT Pub. Date: Sep. 9, 2005

(65) Prior Publication Data

US 2008/0248702 A1 Oct. 9, 2008

(30) Foreign Application Priority Data

Feb. 26, 2004 (AU) ..... 2004900943

(51) Int. Cl.
*B63B 35/00* (2006.01)

(52) U.S. Cl. ..... 441/65; 441/79

(58) Field of Classification Search ..... 114/244, 114/245, 253, 315; 441/65, 66, 74, 79; D21/810
See application file for complete search history.

(56) References Cited

U.S. PATENT DOCUMENTS 2,709,266 A 5/1955 Munn
3,107,640 A 10/1963 Lepine et al.
3,625,172 A 12/1971 Gilster
4,149,483 A 4/1979 Scott, Jr.
4,973,279 A 11/1990 Baumann
5,482,485 A * 1/1996 Ball ..... 441/65
5,558,551 A 9/1996 Irby
5,617,809 A * 4/1997 Arango ..... 441/65
5,655,939 A 8/1997 Salvadores
5,819,680 A * 10/1998 Haller et al. ..... 441/65

FOREIGN PATENT DOCUMENTS

FR 2739608 4/1997
WO WO 01/21477 3/2001

OTHER PUBLICATIONS

International Search Report mailed May 23, 2005.

* cited by examiner

*Primary Examiner*—Lars A Olson
(74) *Attorney, Agent, or Firm*—Nixon & Vanderhye P.C.

(57) ABSTRACT

A recreational water board for towing a person behind a water craft on or below the surface of the water. The board includes a substantially planar structure with a pair of wings on either side of a central axis of symmetry. Each wing has a leading edge and a trailing edge, the leading edge being swept-back to give the board a hydro-dynamically contoured profile. The board also includes handgrips to enable the board to be firmly gripped while being towed, and pairs of apertures arranged symmetrically on either side respectively of a central board axis for attaching a tow bridle to the board. The pairs of apertures define a pivot axis, perpendicular to the central axis, about which the board may be tilted to enable the user to dive or resurface in the water, depending on the direction of tilt.

24 Claims, 8 Drawing Sheets

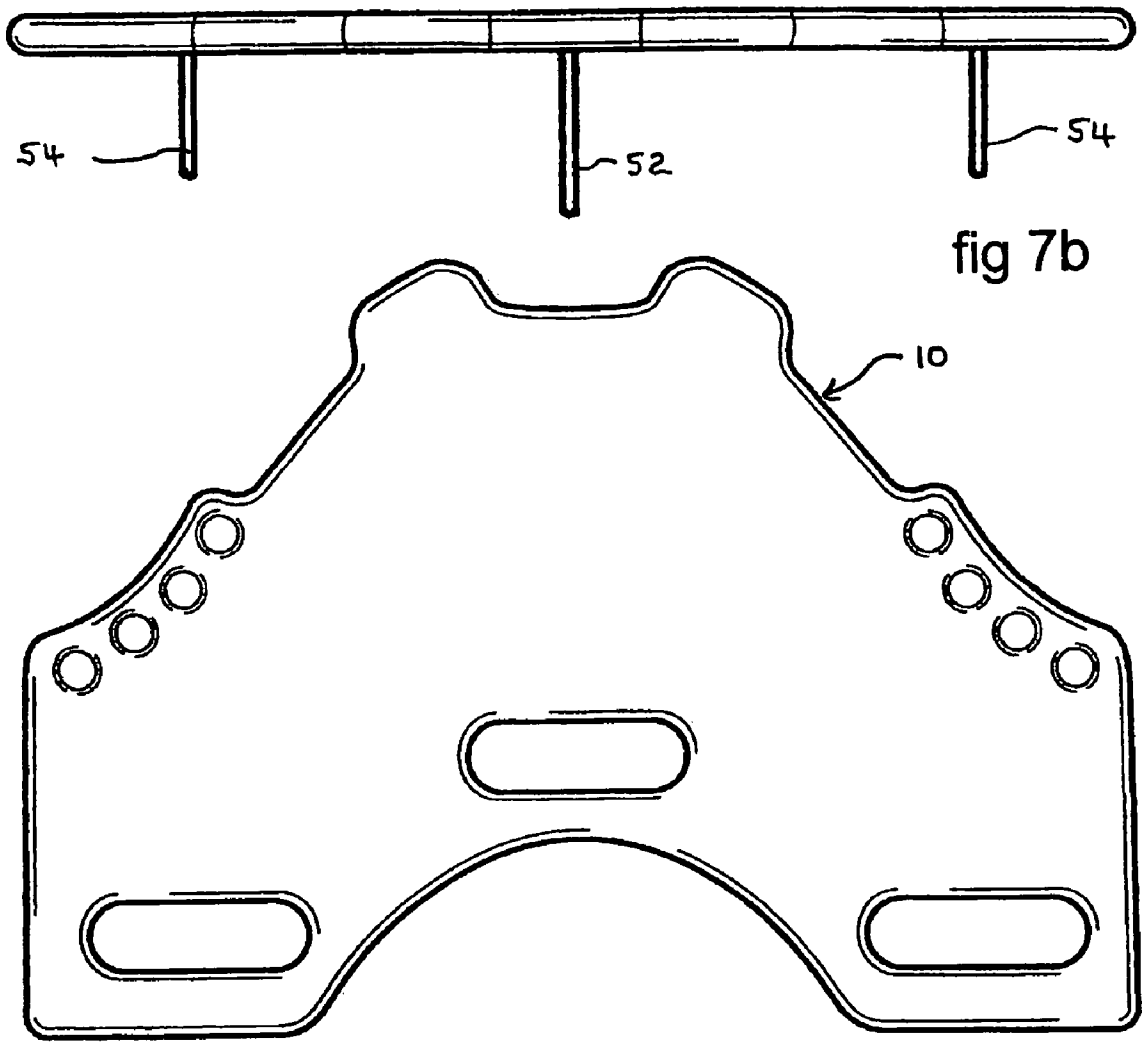
fig 7b
fig 7a
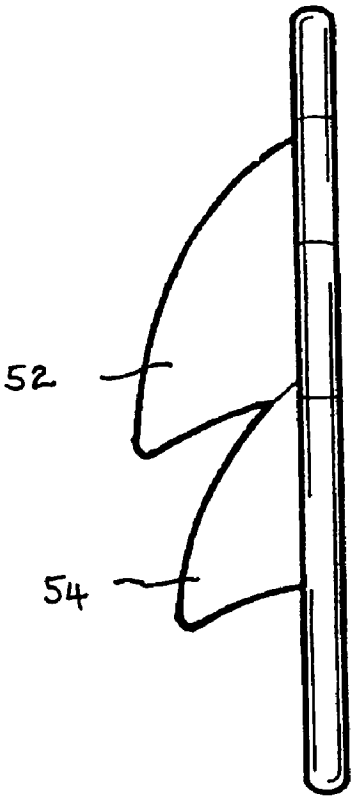
fig 7c

TOWABLE RECREATIONAL WATER BOARD

This application is the U.S. national phase of international application PCT/AU2005/000259 filed 25 Feb. 2005 which designated the U.S. and claims benefit of AU Provisional Application 2004900943, dated 26 Feb. 2004, the entire content of which is hereby incorporated by reference.

FIELD OF THE INVENTION

The present invention relates to a water board designed to be used for towing a person behind a water craft, such as a boat or dinghy, for recreational purposes, either on the surface of the water or under water.

BACKGROUND TO THE INVENTION

In most parts of the world water sports and recreational activities are immensely popular, both on inland lakes as well as on ocean beaches, particularly during the summer months. Water skiing, surfing, snorkelling, body boarding, skin diving, scurfing, wind surfing, swimming, jet skiing and kayaking are just a few of the more popular activities from which people can choose to fill their recreational time.

The present invention was developed with a view to providing a different kind of water board that would give people yet another recreational water sport to choose from that is fun and exhilarating.

References to prior art in this specification are provided for illustrative purposes only and are not to be taken as an admission that such prior art is part of the common general knowledge in Australia or elsewhere.

SUMMARY OF THE INVENTION

According to one aspect of the present invention there is provided a recreational water board for towing a person behind a water craft on or below the surface of the water, the board comprising:

a substantially planar structure, having a pair of wings respectively provided either side of a central axis of symmetry, said structure having a leading edge and a trailing edge, the leading edge of each wing being swept-back to give the board a hydro-dynamically contoured, profile;

at least three handgrips arranged symmetrically on the structure to enable the board to be firmly gripped while being towed, a first pair of rear handgrips being provided adjacent the trailing edge of each wing on either side respectively of said central axis and a third rear handgrip being provided adjacent the trailing edge of the structure substantially aligned with said central axis, each of said rear handgrips being provided in substantially the same plane as said planar structure; and a pair of apertures provided adjacent said leading edge and arranged symmetrically on either side respectively of the central axis for attaching a tow bridle to the board, said pair of apertures defining a pivot axis, perpendicular to said central axis, about which said board may be tilted to enable the user to dive or resurface in the water, in use, depending on the direction of tilt.

According to another aspect of the present invention there is provided a recreational water board for towing a person behind a water craft on or below the surface of the water, the board comprising:

a substantially planar structure formed of buoyant material, having a pair of wings respectively provided either side of a central axis of symmetry, said structure having a leading edge and a trailing edge, the leading edge of each wing being swept-back to give the board a hydro-dynamically contoured profile;

at least one hand grip on the structure to enable the board to be firmly gripped while being towed;

a fin arrangement comprising three fins on an underside of the structure, a central fin positioned on the central axis of symmetry of the structure, and two outer fins spaced equidistantly from the central fin and substantially parallel to the central axis of symmetry; and, a pair of apertures provided adjacent said leading edge and arranged symmetrically on either side respectively of the central axis for attaching a tow rope to the board, said pair of apertures defining a pivot axis, perpendicular to said central axis, about which said board may be tilted to enable the user to dive or resurface in the water, in use, depending on the direction of tilt.

Preferably said pair of apertures is one of a series provided adjacent to the leading edges respectively of each wing, each pair of apertures in said series being spaced progressively closer to each other, either side respectively of said central axis, wherein said pivot axis can be adjusted progressively closer to or further away from the front of the board.

Preferably said tow bridle is coupled to a tow rope by means of a swivel device. Advantageously the tow bridle comprises a single bridle rope coupled at each end to said pair of apertures, said bridle rope being slidably attached to said swivel device whereby the bridle rope is free to slide through the swivel device, thereby permitting the board to be angled from side to side more easily.

Preferably the trailing edge of the structure has a central cut-out portion adapted to accommodate a person's head when the board is held overhead in use.

Preferably the structure is formed of buoyant material with a specific gravity of typically between 0.5 and 0.75. Preferably the buoyant material has a specific gravity of about 0.6 so that the structure may be relatively lightweight and may readily float to the surface of the water.

Preferably a second pair of front handgrips are provided on the leading edge of each wing on either side respectively of said central axis. If desired a third front handgrip may be provided on the leading edge of the structure and located centrally aligned with said third rear handgrip.

Preferably the board further comprises a fin arrangement on an underside of the structure to assist in guiding and steering the board through the water. The fin arrangement may comprise a single fin positioned on an underside of the planar structure. Alternatively, the fin arrangement may comprise a plurality of fins positioned on an underside of the planar structure. Preferably the fin arrangement comprises three fins, namely a central fin positioned on the central axis of symmetry of the structure, and two outer fins spaced equidistantly from the central fin and substantially parallel to the central axis of symmetry.

The central fin is preferably larger than the outer fins, and the outer fins are preferably of substantially equal size. The fins are preferably substantially triangular in shape. The outer edges of the fins are typically curved to assist with ease of movement through the water. Preferably the central fin is positioned in alignment with the third rear handgrip and the outer fins are positioned in alignment with the first pair of rear handgrips.

Throughout the specification, unless the context requires otherwise, the word "comprise" or variations such as "comprises" or "comprising", will be understood to imply the inclusion of a stated integer or group of integers but not the exclusion of any other integer or group of integers.

BRIEF DESCRIPTION OF THE DRAWINGS

The invention will be better understood by reference to the following description of two specific embodiments, given by way of example only, as shown in the accompanying drawings, in which:

FIGS. 7*a*, 7*b* and 7*c* are top plan, front and side views respectively of the water board of FIG. 5;

DETAILED DESCRIPTION OF PREFERRED EMBODIMENT

Figure 1:
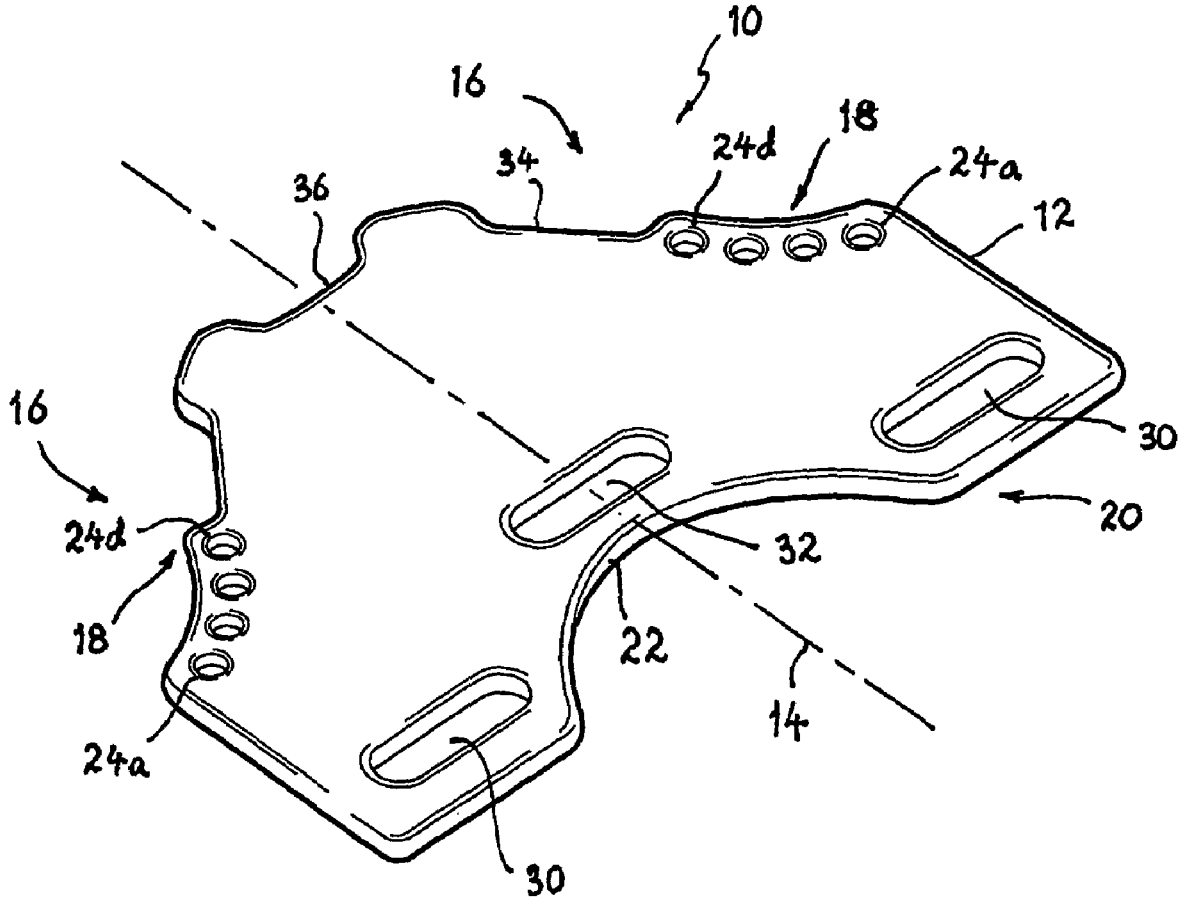
FIG. 1 shows a top perspective view of a first preferred embodiment of the towable recreational water board according to the present invention.
Figure 2:
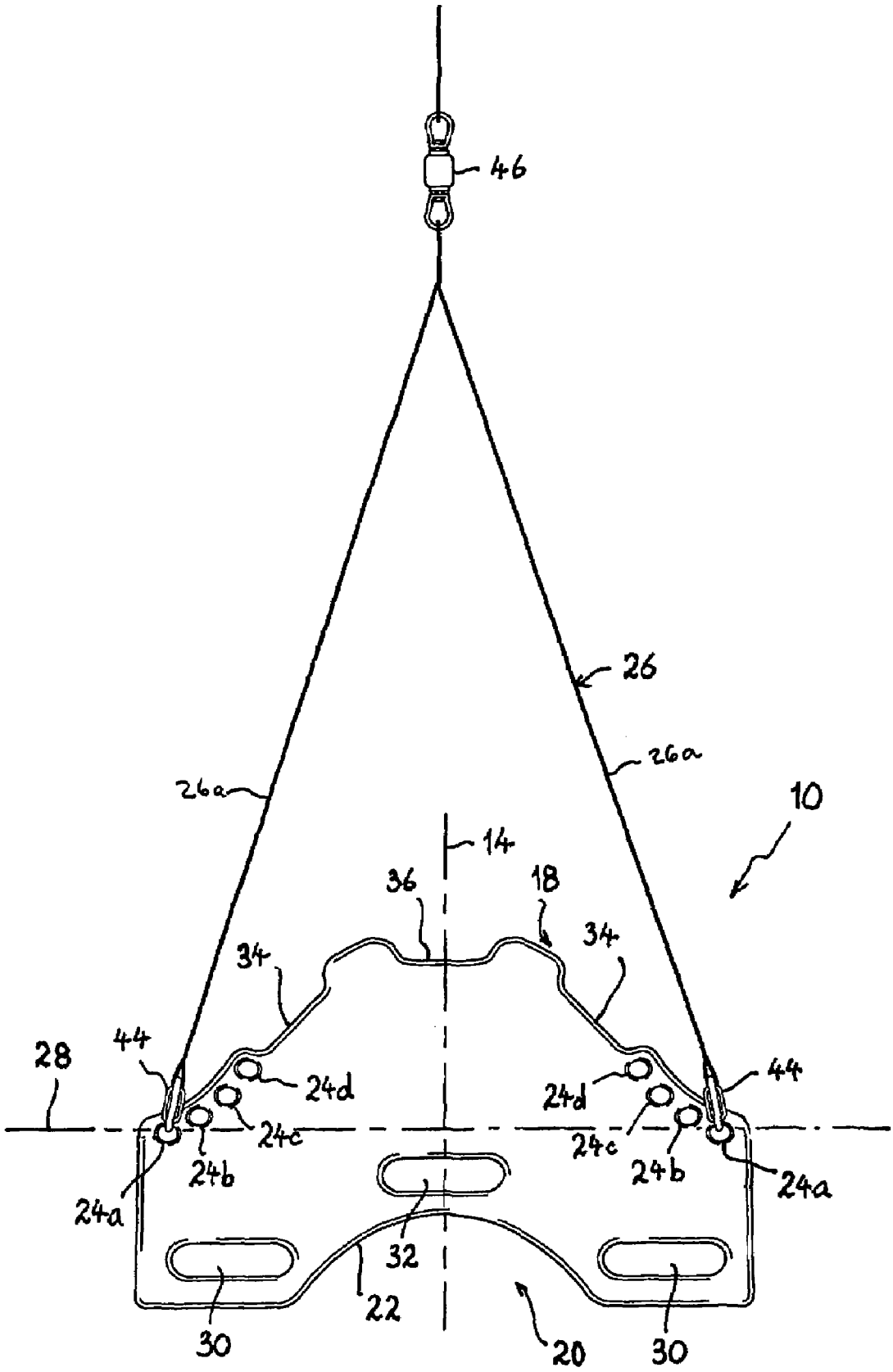
FIG. 2 shows a plan view of the water board of FIG. 1 with a tow rope attached for connection to a water craft.

A first preferred embodiment 10 of the towable recreational water board according to the present invention, as illustrated in FIGS. 1 and 2, comprises a substantially planar structure 12 formed of buoyant material, such as polyethylene plastics material with a specific gravity of typically between 0.5 and 0.75. Preferably the buoyant material has a specific gravity of about 0.6 so that the board is relatively lightweight and will readily float back to the surface when released underwater.

The structure 12 of this embodiment is about 600 mm in width and 400 mm in length, and has a substantially uniform thickness of about 15 mm. It will be understood that the board may come in a variety of other shapes and sizes. The structure 12 has a pair of wings 16 respectively provided either side of a central axis of symmetry 14. The structure 12 has a leading edge 18 and a trailing edge 20. The leading edge 18 of each of the wings 16 is swept-back to give the board a hydrodynamically contoured profile, not dissimilar to that of a manta ray. The trailing edge 20 of the structure 12 has a cut-out portion 22 adapted to accommodate a person's head when the board is held overhead.

The board 10 further comprises a pair of apertures 24*a* provided adjacent the leading edge 18 and arranged symmetrically on either side of the central axis 14 for attaching a tow bridle 26 to the board, as illustrated in FIG. 2. The pair of apertures 24*a* effectively define an axis of pivot 28 about which the board may be tilted to enable the user to dive or resurface in the water, in use, as will be described further below with reference to FIGS. 3 and 4. The pivot axis 28 is substantially perpendicular to the central axis 14 of the board. Preferably less than half of the surface area of the board is located forward of the pivot axis 28.

In this first embodiment, the pair of apertures 24*a* is one of a series of such pairs of apertures 24*a*, 24*b*, 24*c* and 24*d* provided at regular intervals adjacent the leading edges 18 respectively of each wing 16. Each pair of apertures in the series is spaced progressively closer to each other, either side of the central axis 14 of the board, with the first pair of apertures 24*a* being the most spaced apart and a fourth pair of apertures 24*d* being the least spaced apart. Significantly, because of the swept-back profile of the leading edge 18, each pair of apertures 24 in the series is also positioned progressively forward of its neighbour in the direction of the central axis 14. By providing such a series of apertures 24, for attaching the tow bridle 26 to the board, the position of pivot axis 28 can be adjusted progressively closer to the front of the board. This has an important bearing on the ease with which the board my be tilted and/or angled, in use, as will be described in more detail below with reference to FIGS. 3 and 4.

Tow bridle 26 is attached to the apertures 24 by means of shackles 44 that can be rapidly coupled to, or uncoupled from, the apertures 24 to adjust the pivot axis 28 of the board. In the first embodiment the tow bridle 26 is comprised of two sections 26*a* each of about 1.50 meters in length. The tow bridle 26 is preferably coupled to a main tow rope 48, connected to the water craft 42, by means of a swivel 46. The main tow rope 48 is about 20 meters in length. This length allows the person 40 to reach a depth of about 12 meters underwater which is considered a safe depth for use of the board by persons of all ages. The main tow rope 48 may be increased in length to about 50 meters which allows the more experienced user to reach a depth of about 20 meters.

The board 10 further comprises a plurality of handgrips arranged symmetrically on the structure 12 to enable the board to be gripped firmly while being towed. In this embodiment of the water board 10, a first pair of rear handgrips 30 are provided adjacent the trailing edge 20 of each wing 16 on either side respectively of the cut-out portion 22. A third rear handgrip 32 is provided adjacent the trailing edge 20 of the structure and located centrally of the cut-out portion 22. In this embodiment, all three rear handgrips 30 and 32 are provided by forming elongated rectangular slots in the structure 12 adjacent the trailing edge 20 of the board. However the rear handgrips could also be provided by forming handles that protrude from the trailing edge 20 of the board.

The water board may also be provided with a second pair of front handgrips 34 on the leading edge 18 of each wing 16, as in the illustrated first embodiment 10. The pair of front handgrips 34 are located either side respectively of the central axis 14, and are formed by a recessed portion in the leading edge 18 of each wing respectively. A third front handgrip 36 may be provided on the leading edge 18 of the structure 12, and located centrally and aligned with the third rear handgrip 32. Both the front and rear third handgrips 36 and 32 are provided for single-handed operation of the water board 10, in the event that the person being towed on the board wishes to keep their other hand free, for example, for holding onto another object or a companion, or to pinch their nose to equalise the pressure when diving under water.

Figure 5:
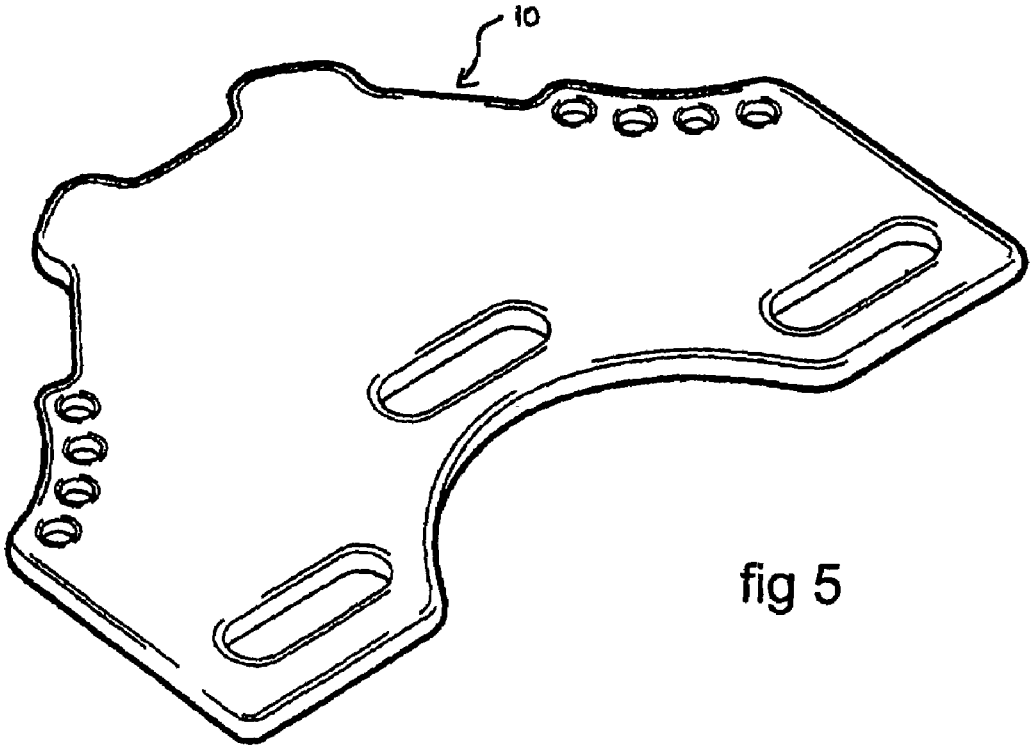
FIG. 5 shows a top perspective view of a second preferred embodiment of the towable recreational water board according to the present invention.
Figure 6:
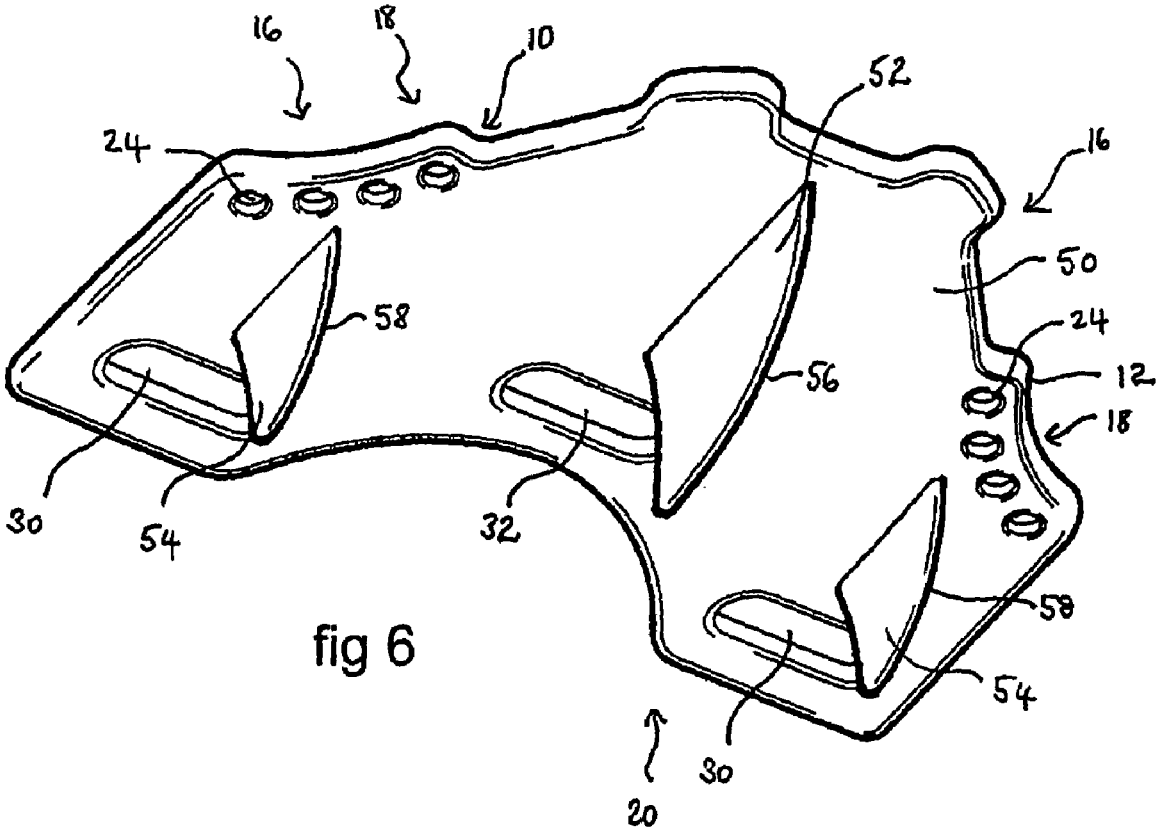
FIG. 6 shows an underside perspective view of the water board of FIG. 5.

The second preferred embodiment as illustrated in FIGS. 5 to 7 resembles the first embodiment in many respects, and the same reference numerals will therefore be used to refer to the same or similar parts. The underside 50 of the water board of the second embodiment is provided with a fin arrangement in the form of larger central fin 52 and two smaller outer fins 54. As can be seen in FIG. 6, the central fin 52 is positioned on the central axis of symmetry of the water board 10 and the outer fins 54 are spaced equidistantly from the central fin 52. The central fin 52 is in alignment with the third rear handgrip 32 and the outer fins 54 are in alignment with the first pair of rear handgrips 30.

The positioning of the fins 52 and 54 close to the handgrips 32 and 30 respectively assists the user of the board to manoeuvre and steer the board 10 through the water. As can be seen in FIG. 6, the fins 52 and 54 have curved edges 56 and 58 respectively directed away from the leading edges 18 towards the trailing edge 20. Furthermore, the fins 52 and 54 protect the hands of the user from obstacles such as rocks present on the ocean or river floor.

Figure 8A:
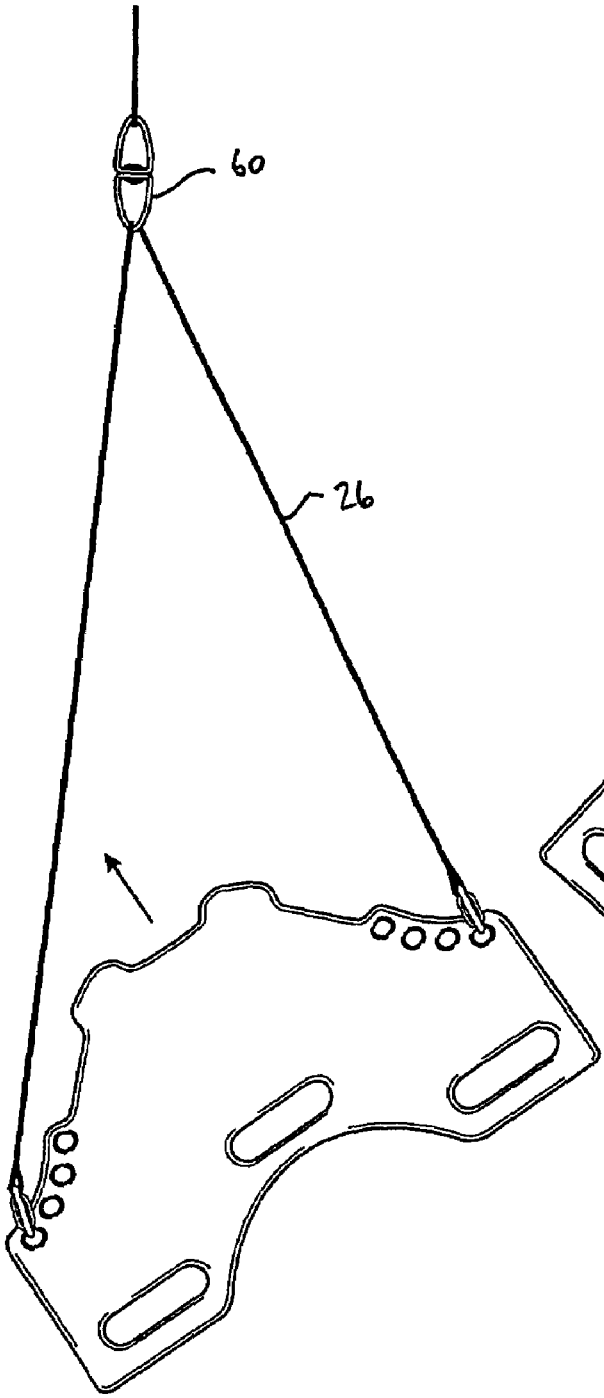
FIGS. 8*a* and 8*b* are plan views of the water board showing how the board may be angled from side to side about the central axis; and, FIG. 9 illustrates a swivel device for attaching the tow bridle of the water board to a tow rope.
Figure 8B:
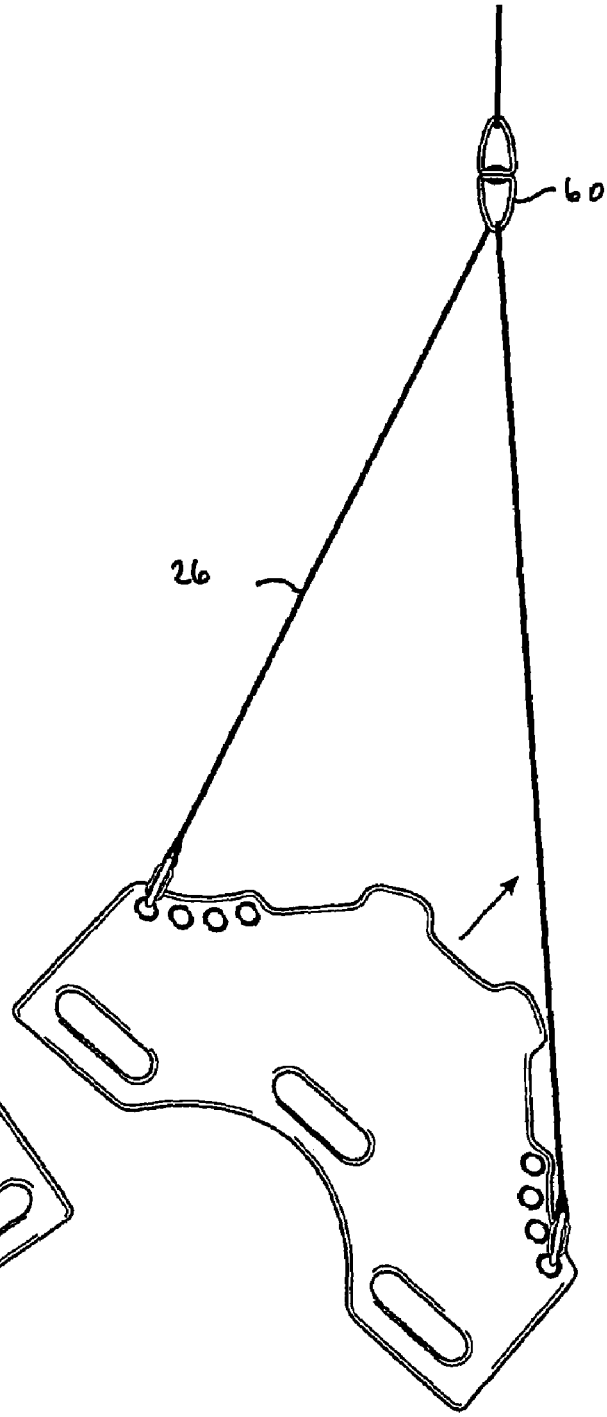
Figure 9:
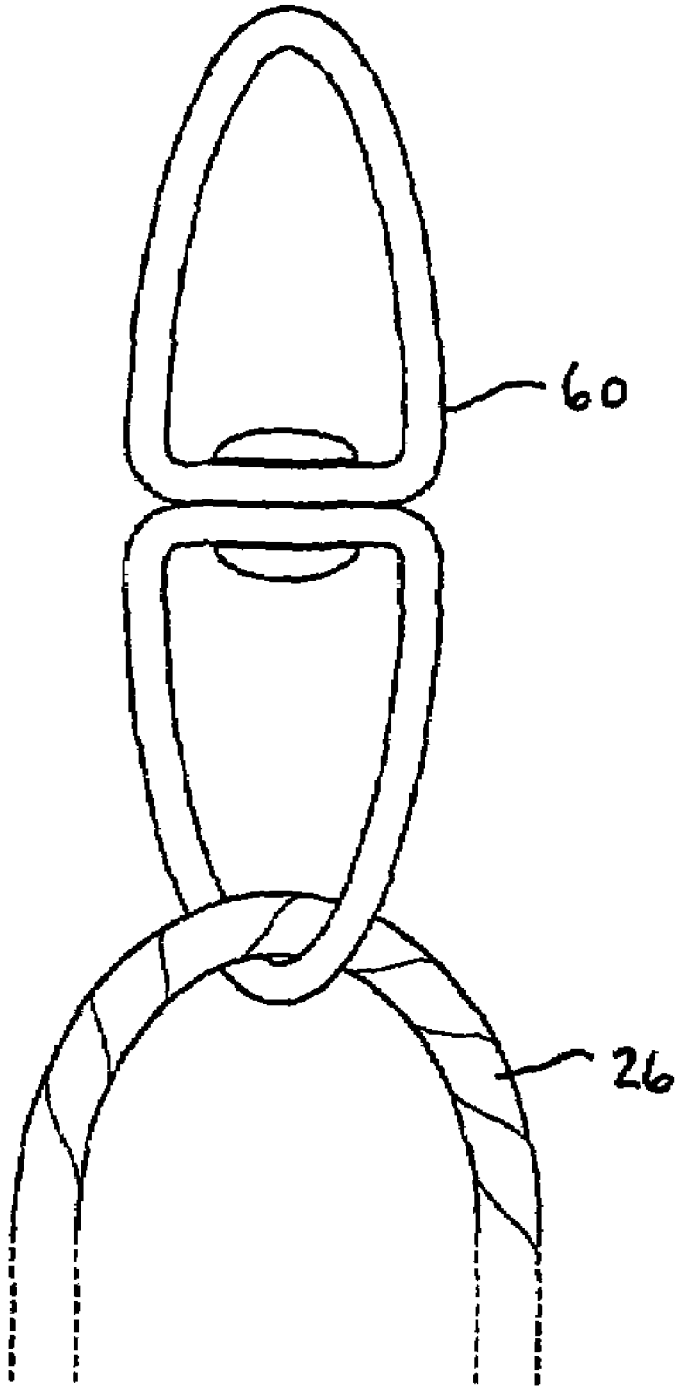

In this embodiment the tow bridle comprises a single bridle rope 26 coupled at each end to the respective apertures 24. The bridle rope 26 is slidably attached to a swivel device 60 whereby the bridle rope is free to slide through the swivel device 60, thereby permitting the board to be angled to either side of the central axis 14 whilst maintaining tension in the bridle rope 26 on both sides of the swivel device 60. FIG. 9 is an enlarged view of the swivel device 60 showing how the bridle rope is free to slide through one loop of the swivel device. This has an important bearing on the ease with which the board may be angled from side to side, in use, as will be described in more detail below with reference to FIGS. 8*a* and 8*b*.

Typical operation of the towable recreational water board 10 of the first embodiment will now be described with reference to FIGS. 3 and 4. As illustrated in FIG. 4, a person 40 who wishes to be towed on the board 10 behind a water craft 42, grips one or more of the handgrips provided on the board 10. In this case the person 40 has gripped the pair of rear handgrips 30. Preferably the person 40 wears a diving mask and snorkel to enable them to remain submerged for longer periods, although this is not essential. The head may be held in an upright position as shown in FIG. 4 or in a horizontal position between the arms, facing down. In the latter position, the head will be accommodated in the cut-out portion 22, especially when the board is held by the front handgrips 34. The water craft 42 typically travels at 2-3 knots through the water when towing the person.

Figure 3A:
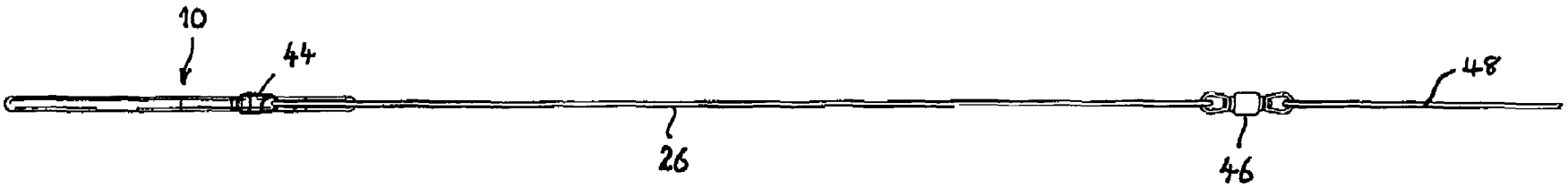
FIGS. 3*a*, 3*b* and 3*c* are side elevations respectively of the water board of FIG. 2 showing how the board may be tilted in use to cause the board to dive or resurface respectively.
Figure 3B:
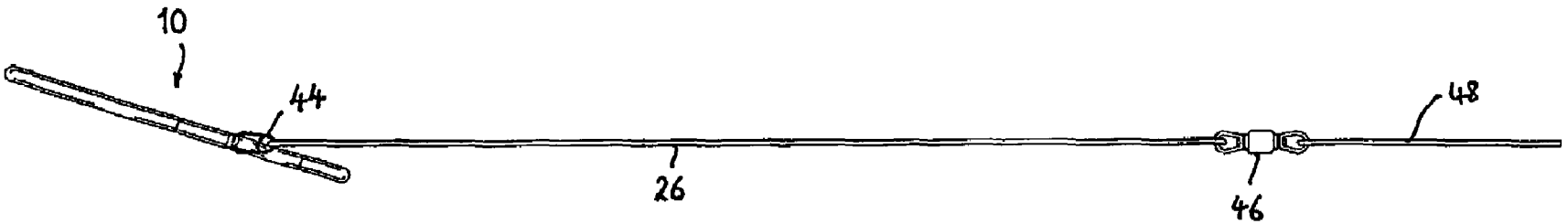
Figure 3C:
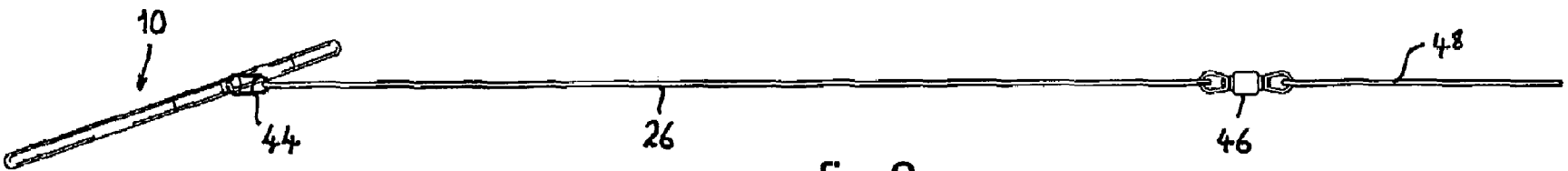
Figure 4:
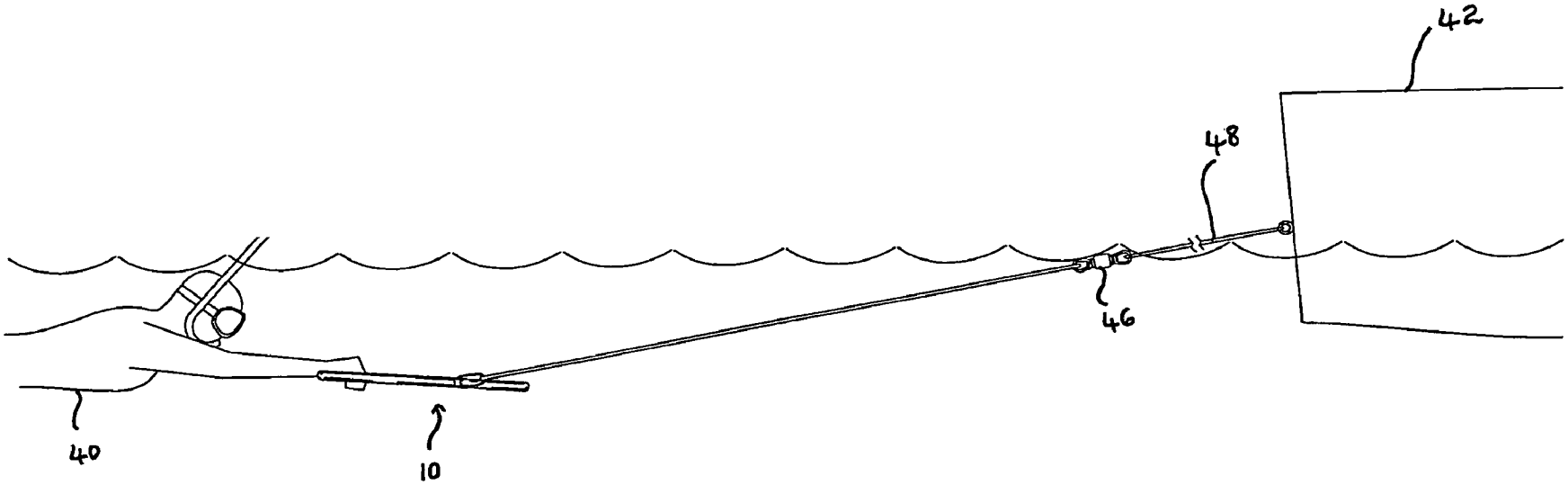
FIG. 4 shows the water board of FIG. 2 being used to tow a person behind a water craft.

When the board 10 is kept in a substantially horizontal orientation as shown in FIGS. 3*a* and 4 it will move through the water in a substantially horizontal motion. In order to dive below the surface of the water, the user tilts the board 10 about the pivot axis 28 so that the leading edge of the board digs into the water as shown in FIG. 3*b*. This has the effect of temporarily creating a high pressure zone on the upper surface of the board and a low pressure zone on the lower surface of the board, causing it to move in a downwards direction. In order to return to the surface, the user tilts the board 10 about the pivot axis 28 so that the leading edge of the board is lifted as shown in FIG. 3*c*. This has the opposite effect of temporarily creating a low pressure zone on the upper surface of the board and a high pressure zone on the lower surface of the board, causing it to move in an upwards direction.

The tilting of the board 10 can be effected by the user applying a torque to the board about the pivot axis 28, by pushing downwards or pulling upwards on the rear handgrips 30 or 32, or pulling upwards or pushing downwards on the front handgrips 34 or 36. The amount of torque required to tilt the board will vary depending on the position of the pivot axis 28. The closer the pivot axis 28 is to the front of the board the easier it becomes for the user to tilt the board. It therefore has the effect of stabilising the board in use, as it tends to want to return to the horizontal rest position. On the other hand, the further away from the front of the board the pivot axis is located the more difficult it becomes for the user to tilt the board. It therefore has the effect of making the board less stable in use, as it tends to want to more readily depart from the horizontal rest position. Therefore, the tow rope 26 is generally attached to the foremost pair of apertures 24*d* when the board is being used by a child or beginner. The position of the tow rope connection points can be adjusted for more experienced users.

Swivel 46 permits rotation of the water board 10 about its central axis 14 without twisting the main tow rope. This provides a further degree of freedom in the types of manoeuvres that can be performed with the water board 10 in use. For example, by tilting the board sideways about the central axis 14 the user can do one or more "barrel rolls" to turn 360 degrees underwater. As the material from which the board is made is not too rigid to permit a degree of flexing by the user, its direction of travel on or under the water can be further controlled by flexing the board in different directions and to varying degrees, if desired.

Typical operation of the towable recreational water board 10 of the second embodiment will now be described with reference to FIGS. 8*a* and 8*b*. The water board 10 of FIGS. 5 to 8 is used in much the same way as that illustrated in FIGS. 1 to 4, however in this case the provision of the fin arrangement on the underside of the board allows the water board 10 to be more easily turned from side to side away from the direction of travel of the water craft. Swivel device 60 permits angling of the water board 10 away from the direction of travel without loosening the tension in the bridle rope 26. This provides a further degree of freedom in the types of manoeuvres that can be performed with the water board 10 in use. For example, by turning the board sideways, to the left or the right, the user can travel at an angle to the direction of travel of the water craft as shown in FIGS. 8*a* and 8*b*.

It will be appreciated that two or more persons may be towed simultaneously on separate boards behind the same water craft to vary the recreational experience. Lights and/or other decorative features, such as stripes, may be placed at prominent points on the board to further enhance its aesthetic appeal.

From the above description of a preferred embodiment of the towable recreational water board it will be apparent that it has a number of advantages, including the following:

(i) It is lightweight and easy to use by both children and adults;

(ii) It is simple and inexpensive to manufacture using a plastics material moulding process and therefore readily lends itself to mass production;

(iii) Its planar construction means that it can be easily packed, stored and transported in large quantities;

(iv) Its manoeuvrability in the water, both on and below the surface, facilitates a wide range of movements and recreational activities.

It will be readily apparent to persons skilled in the relevant arts that various modifications and improvements may be made to the foregoing embodiments, in addition to those already described, without departing from the basic inventive concepts of the present invention. For example, the structure 12 of the board may include one or more longitudinal V-shaped grooves and/or ribs extending substantially parallel to the central axis of the board. Therefore, it will be appreciated that the scope of the invention is not limited to the specific embodiments described.

The invention claimed is:

1. A recreational water board for towing a person behind a water craft on or below the surface of the water, the board comprising:

a substantially planar structure, having a pair of wings respectively provided either side of a central axis of symmetry, said structure having a leading edge and a trailing edge, the leading edge of each wing being swept-back to give the board a hydro-dynamically contoured profile;

at least six handgrips arranged symmetrically on the structure to enable the board to be firmly gripped while being towed, the at least six handgrips include a first pair of rear handgrips being provided adjacent the trailing edge of each wing on either side respectively of said central axis, a third rear handgrip being provided adjacent the trailing edge of the structure substantially aligned with said central axis, each of said rear handgrips being provided in substantially the same plane as said planar structure, a second pair of front handgrips being provided adjacent a leading edge of each wing and on either side respectively of said central axis, and a third front handgrip being provided on the leading edge of the structure and aligned with said third rear handgrip along the central axis; and a pair of apertures provided adjacent said leading edge and arranged symmetrically on either side respectively of the central axis for attaching a tow bridle to the board, said pair of apertures defining a pivot axis, perpendicular to said central axis, about which said board may be tilted to enable the user to dive or resurface in the water, in use, depending on a direction of tilt.

2. A recreational water board according to claim 1 wherein said pair of apertures is one of a series provided adjacent to the leading edges respectively of each wing.

3. A recreational water board according to claim 2 wherein each pair of apertures in said series is spaced progressively closer to each other, either side respectively of said central axis, wherein said pivot axis can be adjusted progressively closer to or further away from a front of the board.

4. A recreational water board according claim 1 wherein said tow bridle is coupled to a tow rope by a swivel device.

5. A recreational water board according to claim 4 wherein the tow bridle comprises a single bridle rope coupled at each end to said pair of apertures, said bridle rope being slidably attached to said swivel device whereby the bridle rope slide through the swivel device.

6. A recreational water board according to claim 1 wherein the trailing edge of the structure has a central cut-out portion adapted to accommodate a person's head when the board is held overhead in use.

7. A recreational water board according to claim 1 wherein the structure is formed of buoyant material with a specific gravity of between 0.5 and 0.75.

8. A recreational water board according to claim 7 wherein the buoyant material has a specific gravity of about 0.6.

9. A recreational water board according claim 1 wherein the board further comprises a fin arrangement on an underside of the structure.

10. A recreational water board according to claim 9 wherein the fin arrangement comprises a single fin positioned on an underside of the planar structure.

11. A recreational water board according to claim 9 wherein the fin arrangement comprises a plurality of fins positioned on an underside of the planar structure.

12. A recreational water board according to claim 11 wherein the fin arrangement comprises a central fin positioned on the central axis of symmetry of the structure, and two outer fins spaced equidistantly from the central fin and substantially parallel to the central axis of symmetry.

13. A recreational water board according to claim 12 wherein the central fin is larger than the outer fins, and wherein the outer fins are of substantially equal size.

14. A recreational water board according to claim 13 wherein the outer fins are each substantially triangular in shape.

15. A recreational water board according to claim 14 wherein the outer edges of the fins are curved.

16. A recreational water board according claim 15 wherein the central fin is positioned in alignment with the third rear handgrip and the outer fins are positioned in alignment with the first pair of rear handgrips.

17. A recreational water board for towing a person behind a water craft on or below the surface of the water, the board comprising:

a substantially planar structure formed of buoyant material, having a pair of wings respectively provided either side of a central axis of symmetry, said structure having a leading edge and a trailing edge, the leading edge of each wing being swept-back to give the board a hydro-dynamically contoured profile;

at least six handgrips arranged symmetrically on the structure to enable the board to be firmly gripped while being towed, the at least six handgrips include a first pair of rear handgrips each adjacent a trailing edge of one of the wings and arranged symmetrically about said central axis, a third rear handgrip adjacent the trailing edge of the structure and aligned with the central axis, wherein each of said rear handgrips are in a plane of said planar structure, a second pair of front handgrips adjacent the leading edge of each wing and arranged symmetrically about the central axis, and a third front handgrip on the leading edge of the structure and aligned with said third rear handgrip along the central axis;

a fin arrangement comprising three fins on an underside of the structure, a central fin positioned on the central axis of symmetry of the structure, and two outer fins spaced equidistantly from the central fin and substantially parallel to the central axis of symmetry; and, a pair of apertures provided adjacent said leading edge and arranged symmetrically on either side respectively of the central axis for attaching a tow rope or bridle to the board, said pair of apertures defining a pivot axis, perpendicular to said central axis, about which said board may be tilted when attached to the tow rope or toe bridle, said front handgrips being forward of the pivot axis and the rear handgrips being aft of the pivot axis.

18. A recreational water board according to claim 17 wherein the central fin is larger than the outer fins, and wherein the outer fins are of substantially equal size.

19. A recreational water board according to claim 17 wherein the trailing edge of the structure has a central cut-out portion adapted to accommodate a person's head when the board is held overhead in use.

20. A recreational water board according to claim 17 wherein the structure is formed of buoyant material with a specific gravity of between 0.5 and 0.75.

21. A recreational water board according to claim 20 wherein the buoyant material has a specific gravity of about 0.6.

22. A recreational water board according to claim 17 wherein the central fin is positioned in alignment with the third rear handgrip and the outer fins are positioned in alignment with the first pair of rear handgrips.

23. A water tow board comprising:

a planar structure having a center section with a leading region and a trailing region, and pair of wings arranged on opposite sides of the center section, wherein the wings are arranged symmetrically about the center section, each wing has a leading region swept back with respect to the leading edge of the center section and each wing has a trailing region;

a pair of bridle connections on the board and arranged symmetrically about a central axis for coupling the board to a tow rope or tow bridle, wherein the bridle connections define a pivot axis perpendicular to the center axis;

at least six handgrips including a front handgrip arranged in each of the leading regions of the wings and center section, and a rear handgrip arranged in each of the trailing regions for each of the wings and the center section, wherein the front handgrips are forward of the pivot axis and the rear handgrips are aft of the pivot axis.

24. The water tow board as in claim 23 wherein the pair of bridle connections are separated by a distance greater than a distance separating the front handgrips in the leading regions and a distance separating the rear handgrips in the trailing regions.

* * * * *